US006581423B2

(12) United States Patent
Lin

(10) Patent No.: US 6,581,423 B2
(45) Date of Patent: Jun. 24, 2003

(54) DOOR LOCK

(76) Inventor: Ching-Tien Lin, No. 2, Lane 112, Chu-Yuan Road, Hsin-Chung, Taipei Hsien (TW)

( * ) Notice: Subject to any disclaimer, the term of this patent is extended or adjusted under 35 U.S.C. 154(b) by 0 days.

(21) Appl. No.: 09/984,996

(22) Filed: Nov. 1, 2001

(65) Prior Publication Data

US 2003/0079508 A1 May 1, 2003

(51) Int. Cl.[7] ..... E05B 13/00; E05B 59/00

(52) U.S. Cl. ..... 70/107; 70/149; 70/218; 70/277; 70/472; 70/486; 292/DIG. 27; 292/DIG. 66

(58) Field of Search ..... 70/218, 222–224, 70/107, 472, 483–487, 149, 277, 278.7, 283, 422; 292/DIG. 27, DIG. 66

(56) References Cited

U.S. PATENT DOCUMENTS

| | | | | | |
|---|---|---|---|---|---|
| 3,672,714 | A | * | 6/1972 | Schultz | 292/34 |
| 4,429,556 | A | * | 2/1984 | Kambic | 70/149 |
| 4,709,950 | A | * | 12/1987 | Zortman | 292/92 |
| 4,995,248 | A | * | 2/1991 | Liu | 70/107 |
| 5,113,675 | A | * | 5/1992 | Uyeda | 70/477 |
| 5,464,259 | A | * | 11/1995 | Cohrs et al. | 292/92 |
| 5,475,996 | A | * | 12/1995 | Chen | 70/279.1 |
| 5,527,074 | A | * | 6/1996 | Yeh | 292/177 |
| 5,640,863 | A | * | 6/1997 | Frolov | 70/283 |
| 5,896,764 | A | * | 4/1999 | Monsch et al. | 70/107 |
| 2002/0139156 | A1 | * | 10/2002 | Aramburu et al. | 70/218 |
| 2003/0019256 | A1 | * | 1/2003 | Frolov | 70/222 |

FOREIGN PATENT DOCUMENTS

| | | | | |
|---|---|---|---|---|
| DE | 685943 | * | 12/1939 | 70/218 |
| GB | 2262770 | * | 6/1993 | 70/224 |

* cited by examiner

*Primary Examiner*—Lloyd A. Gall
(74) *Attorney, Agent, or Firm*—Bacon & Thomas, PLLC

(57) ABSTRACT

A door lock is proposed, in which an outside knob assembled at the outside of a door can be manually controlled to be operationally associated with or dissociated from the door lock. When the door lock is fastened, the outside knob can be selectively decoupled from the door lock and become idle; this is greatly beneficial as to prevent the door lock from being damaged even if the outside knob is exerted with external impact or forcibly turned by a strong force. The door lock is further provided with a fireproof mechanism, which prevents the door from being opened during a fire, thereby confining spreading of the fire to minimize fire-induced damage.

20 Claims, 10 Drawing Sheets

DOOR LOCK

FIELD OF THE INVENTION

The present invention relates to door locks, and more particularly, to a door lock by which a doorknob can be selectively decoupled in operation from the door lock and become idle when the door lock is fastened, so as to prevent the door lock from being damaged in case of the doorknob being exerted with external impact or forcibly turned by a strong force.

BACKGROUND OF THE INVENTION

As shown in FIG. 1, a conventional door lock mainly comprises: a housing 10'; a dead bolt 201' received in the housing 10' and operatably driven by a key (not shown); a latch bolt 401' retained in the housing 10' and operatably driven by at least a doorknob (not shown); a safety bolt 301' urged to hold the latch bolt 401' at a predetermined position; and a doorknob mechanism 50' associated with the latch bolt 401' and the doorknob, so as to transfer a force generated by turning the doorknob for driving the latch bolt 401' to operate. In practical use, this conventional door lock mounted on a door allows a user to operate the doorknob and the latch bolt 401' to open or close the door. When the door is locked by the door lock, the dead bolt 201' and the latch bolt 401' respectively protrude outwardly from the housing 10' to be engaged with a lock coupler, which is installed at a frame of the door and corresponds in position to the door lock. In the meantime, the safety bolt 301' is compressed by the frame of the door, and cooperates with a latch board 302' to hold the latch bolt 401' at the protruding position by which the door lock is fastened and the latch bolt 401' is blocked against operation driven by the doorknob. Therefore, with the door lock being fastened, the door can be securely locked without being easily opened.

However, the above conventional door lock is inherent with significant drawbacks. When the door lock is fastened, since the latch bolt 401' and the doorknob are operationally blocked, if the doorknob is exerted with external impact and forcibly turned by a strong force, the doorknob mechanism 50' and other associated internal components would be easily damaged to impair the door lock. Moreover, the door lock is not provided with a fireproof mechanism for preventing the door from being opened when a fire occurs, and thereby is not applicable to a fire door. This is because, during the fire, if a fire door used for limiting spread of the fire is accidentally opened, fresh air is introduced and helps proliferate the fire, making damage caused by the fire even more severe.

Therefore, it is greatly desired to develop a door lock, which can be prevented from being damaged by externally-applied force or impact, and also suitably used for a fire door.

SUMMARY OF THE INVENTION

An objective of the present invention is to provide a door lock by which an outside knob can be selectively decoupled in operation from the door lock and become idle when the door lock is fastened, so as to prevent the door lock from being damaged in case of the outside knob being exerted with external impact or forcibly turned by a strong force.

Another objective of the present invention is to provide a door lock, whereby when a fire occurs, the door lock is urged by high temperature of the fire to hold a latch bolt at a position for fastening the door lock, so that a door mounted with the door lock is prevented from being opened during the fire, and spreading of the fire can be confined so as to minimize fire-induced damage.

In accordance with the above and other objectives, the present invention proposes a door lock, comprising: a housing integrally connected with a cover, for receiving internal components of the door lock therein; and a first and a second doorknobs externally connected to the internal components of the door lock.

The internal components of the door lock comprise: a dead bolt adapted to be operatably driven by a key through a keyhole formed on the housing; a latch bolt adapted to be operatably driven by at least one of the first and second doorknobs; a first doorknob mechanism associated with the latch bolt and the first doorknob; and a second doorknob mechanism integrally connected to the first doorknob mechanism, and associated with the latch bolt and the second doorknob.

In particular, the first doorknob mechanism comprises: a first body formed with a recessed portion; a first pivot member received in the recessed portion of the first body, and externally connected to the first doorknob, so as to allow the first doorknob to be operationally associated with the first pivot member; at least a first coupling member adapted to be capable of being selectively coupled to the first body and the first pivot member; a first fixture attached onto the first body and associated with the latch bolt, the first fixture being adapted for retaining the first pivot member within the recessed portion of the first body, and for preventing the first coupling member from escaping out of the first body; and a control means associated with the first coupling member, for manually controlling positioning of the first coupling member with respect to the first body and the first pivot member.

The second doorknob mechanism is connected to the first doorknob mechanism, and comprises: a second body formed with a recessed portion, and engaged with the first body of the first doorknob mechanism in a manner that, the recessed portion of the second body is positionally opposed to the recessed portion of the first body; a second pivot member received in the recessed portion of the second body, and externally connected to the second doorknob, so as to allow the second doorknob to be operationally associated with the second pivot member; at least a second coupling member adapted to be simultaneously coupled to the second body and the second pivot member; a second fixture attached onto the second body and associated with the latch bolt, the second fixture being adapted for retaining the second pivot member within the recessed portion of the second body, and for holding the second coupling member in position; and at least a fixing means for integrally connecting the second fixture, the second coupling member and the second body, so as to allow the second pivot member and the second doorknob to cooperate with the second doorknob mechanism as a whole for driving the latch bolt to operate.

In another embodiment, the control means can be associated with the first coupling member by a power means, which provides power for driving operational association between the control means and the first coupling member.

With the use of the above door lock, the first doorknob usually assembled at the outside of a door (i.e. outside knob), can be manually controlled to be operationally associated with or dissociated from the first doorknob mechanism of the door lock. In other words, when the door lock is fastened, the outside knob can be selectively decoupled from the door lock and become idle; this is greatly beneficial as to prevent the door lock from being damaged even if the outside knob is exerted with external impact or forcibly turned by a strong force.

The internal components of the above door lock further comprise: a fireproof mechanism having a blocking member associated with the latch bolt, and a positioning means for allowing the blocking member to be interposed between the latch bolt and the positioning means, the positioning means being formed with a movable portion and a fixed portion, wherein the blocking member is shifted from a first position in contact with the movable portion of the positioning means, to a second position in contact with the fixed portion of the positioning means in response to high temperature. When the blocking member is held at the first position, the latch bolt is operatably driven by the doorknob to freely open the door equipped with the door lock. Alternatively, when a fire occurs and the blocking member is shifted to the second position in response to high temperature of the fire, the latch bolt would be kept in a position for fastening the door lock and operationally blocked by the fixed portion of the positioning means; this prevents the door from being opened during the fire, thereby confining spreading of the fire to minimize fire-induced damage.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
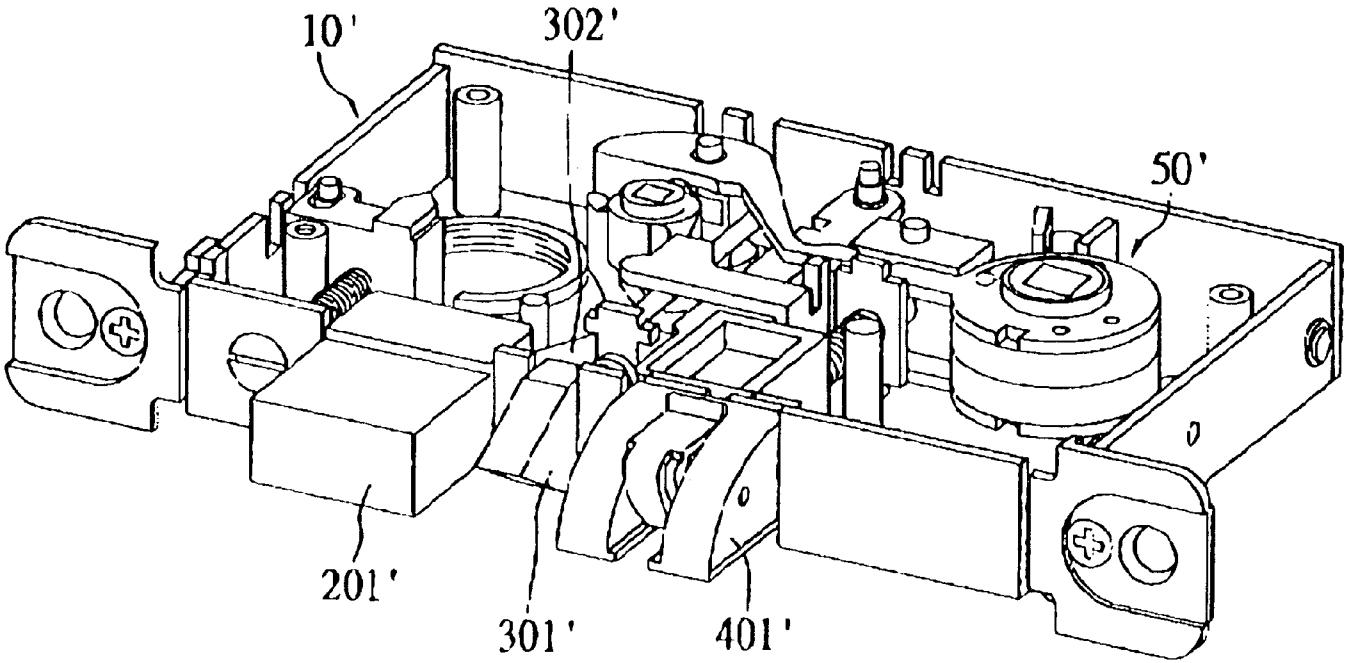
FIG. 1 (PRIOR ART)
FIG. 1 (PRIOR ART) is a perspective view of a conventional door lock.
Figure 2:
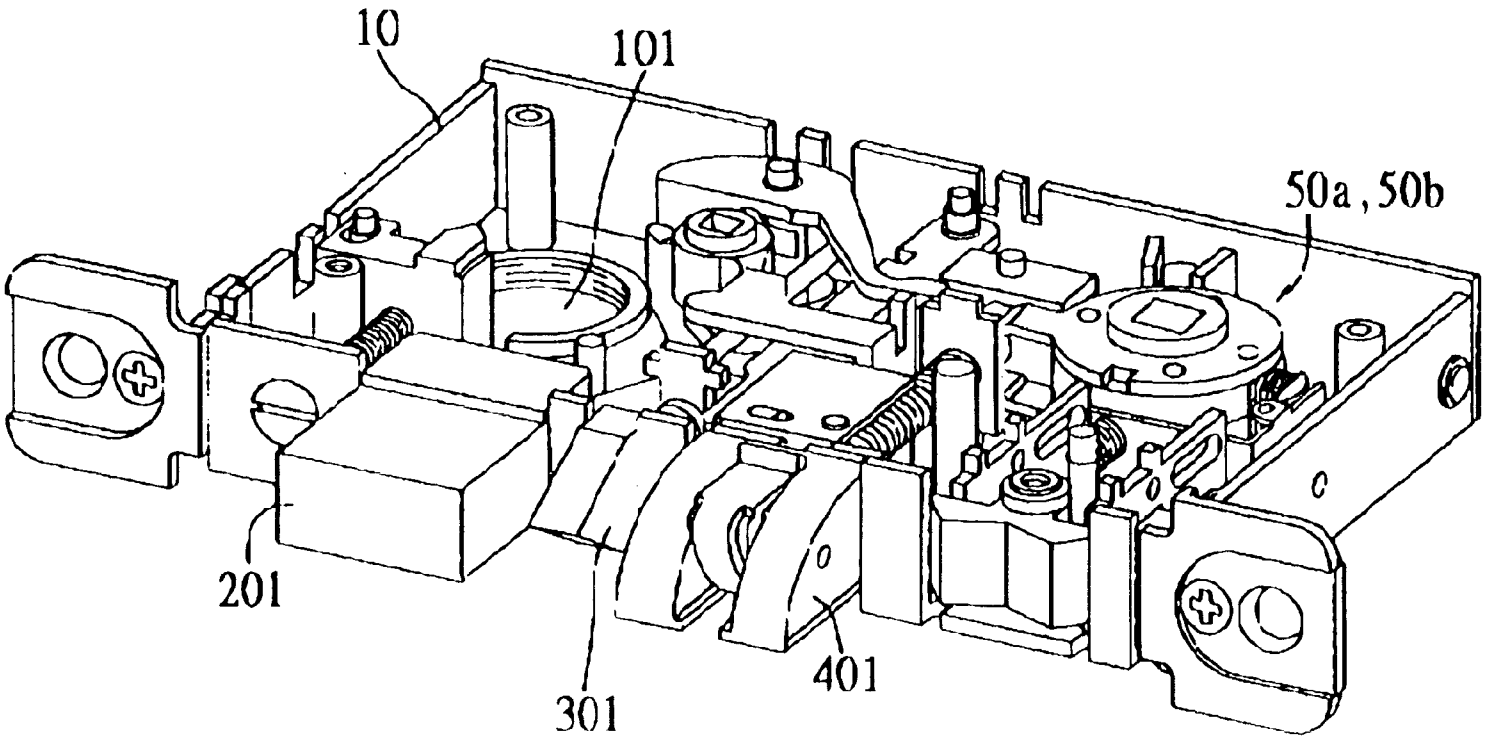
FIG. 2 is a perspective view of a preferred embodiment of a door lock of the invention.

The following description is made with reference to FIGS. 2–10 for illustrating preferred embodiments of structural configuration of a door lock proposed in the present invention, and for depicting operational mechanisms in the use of the door lock.

Referring to FIGS. 2–6, the door lock of the invention is structurally represented. This door lock comprises: a housing 10 integrally connected with a cover (not shown), for receiving internal components of the door lock therein; and a first and a second doorknobs 70, 71 externally connected to the internal components of the door lock.

The internal components of the door lock comprise: a dead bolt 201 adapted to be operatably driven by a key 102 through a keyhole 101 formed on the housing 10, whereby when the dead bolt 201 is urged to protrude outwardly from the housing 10 and to be engaged with a lock coupler (not shown) mounted at a door frame, the door lock is fastened to lock the door equipped with the door lock; a safety bolt 301 for holding a latch bolt 401 in a lock-fastened position when the safety bolt 301 is compressed inside the housing 10; a latch bolt 401 adapted to be operatably driven by at least one of the first and second doorknobs 70, 71, whereby when the latch bolt 401 is urged to protrude outwardly from the housing 10 and to be engaged with the lock coupler, the door lock is fastened; a first doorknob mechanism 50*a* associated with the latch bolt 401 and the first doorknob 70; and a second doorknob mechanism 50*b* integrally connected to the first doorknob mechanism 50*a*, and associated with the latch bolt 401 and the second doorknob 71.

In this embodiment, the first doorknob 70 is customarily referred to as an outside knob installed at the outside of the door, and the second doorknob 71 is correspondingly an inside knob assembled inside the door. Nevertheless, reverse arrangement of the doorknobs 70, 71 with respect to the door is also suitably adopted according to practical requirements.

Figure 3:
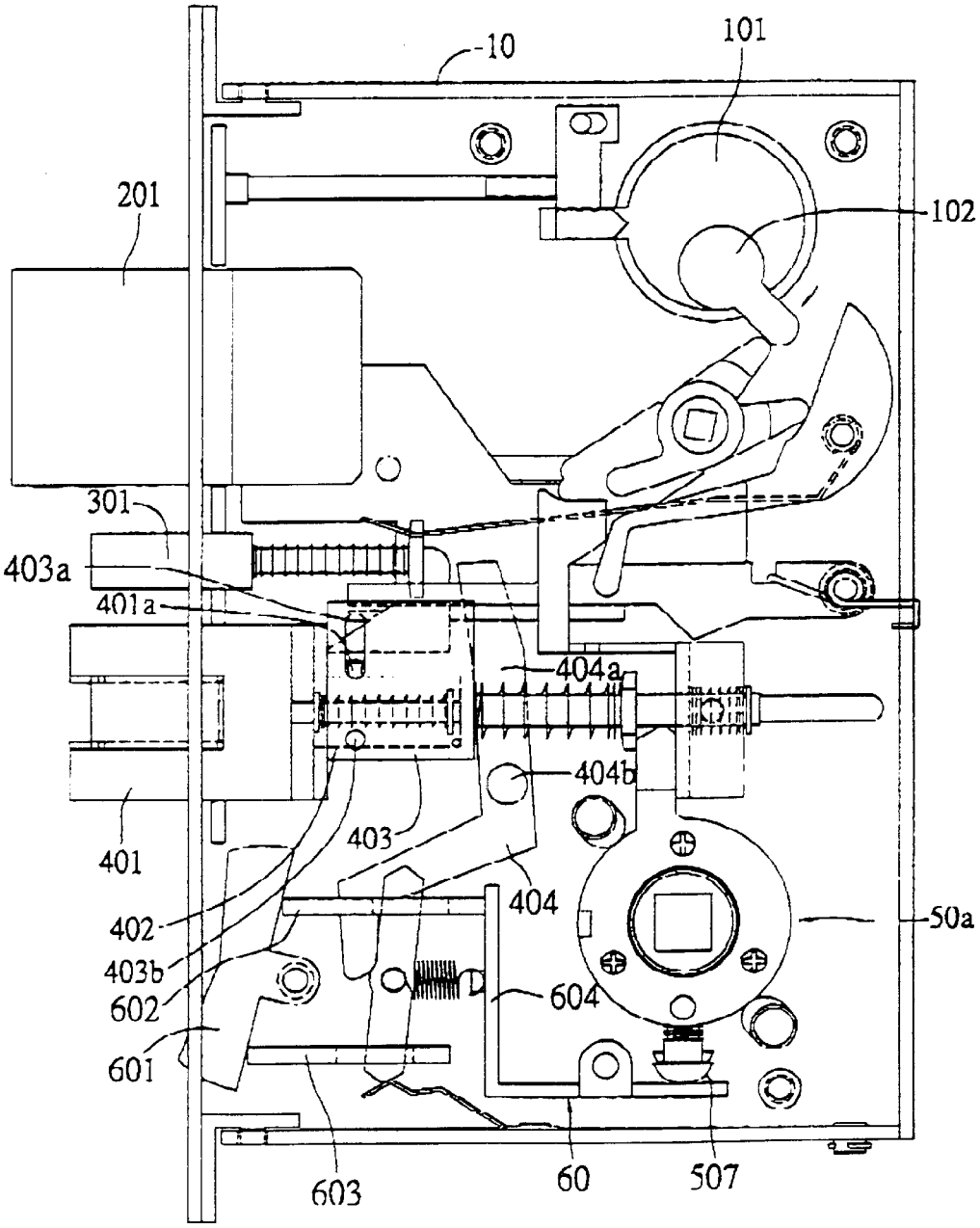
FIG. 3 is a top view showing internal structure of the door lock of FIG. 2.
Figure 5:
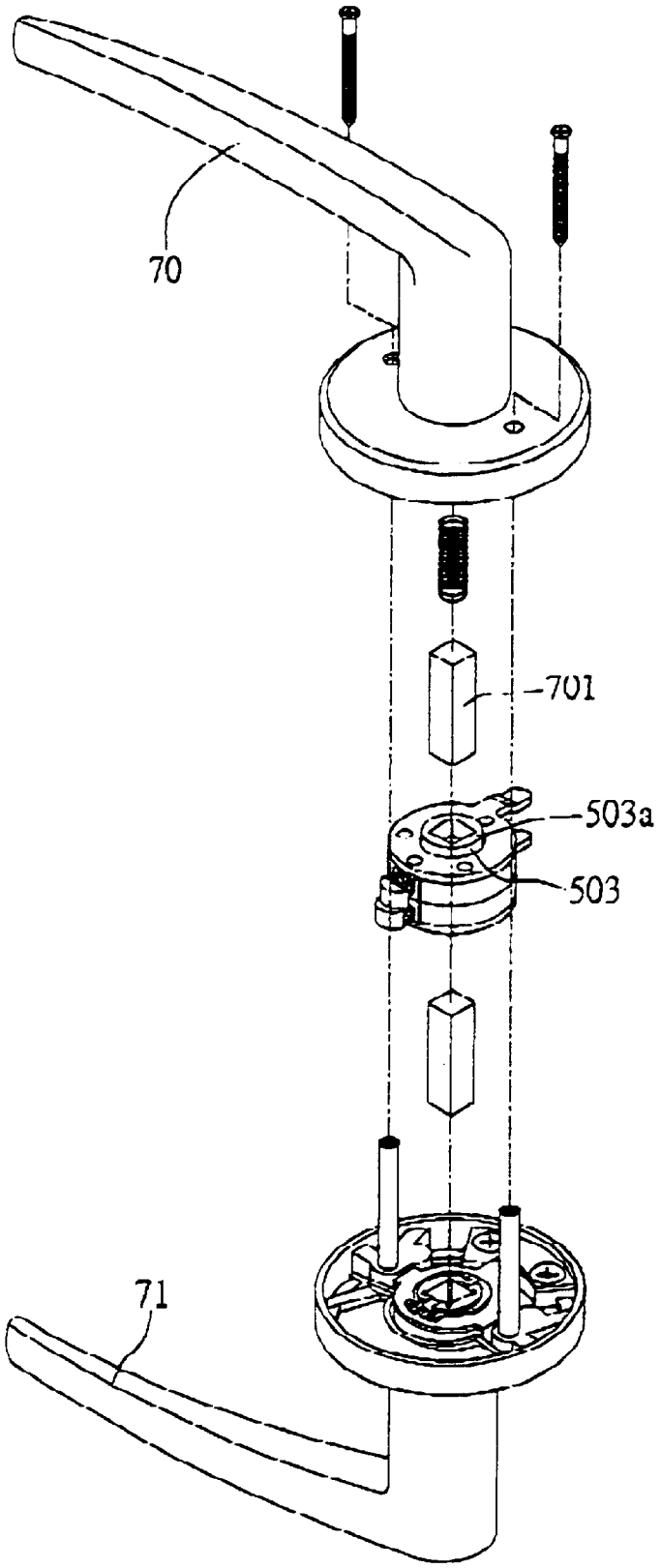
FIG. 5 is a perspective view showing doorknobs respectively assembled to doorknob mechanisms of the door lock of the invention.
Figure 6:
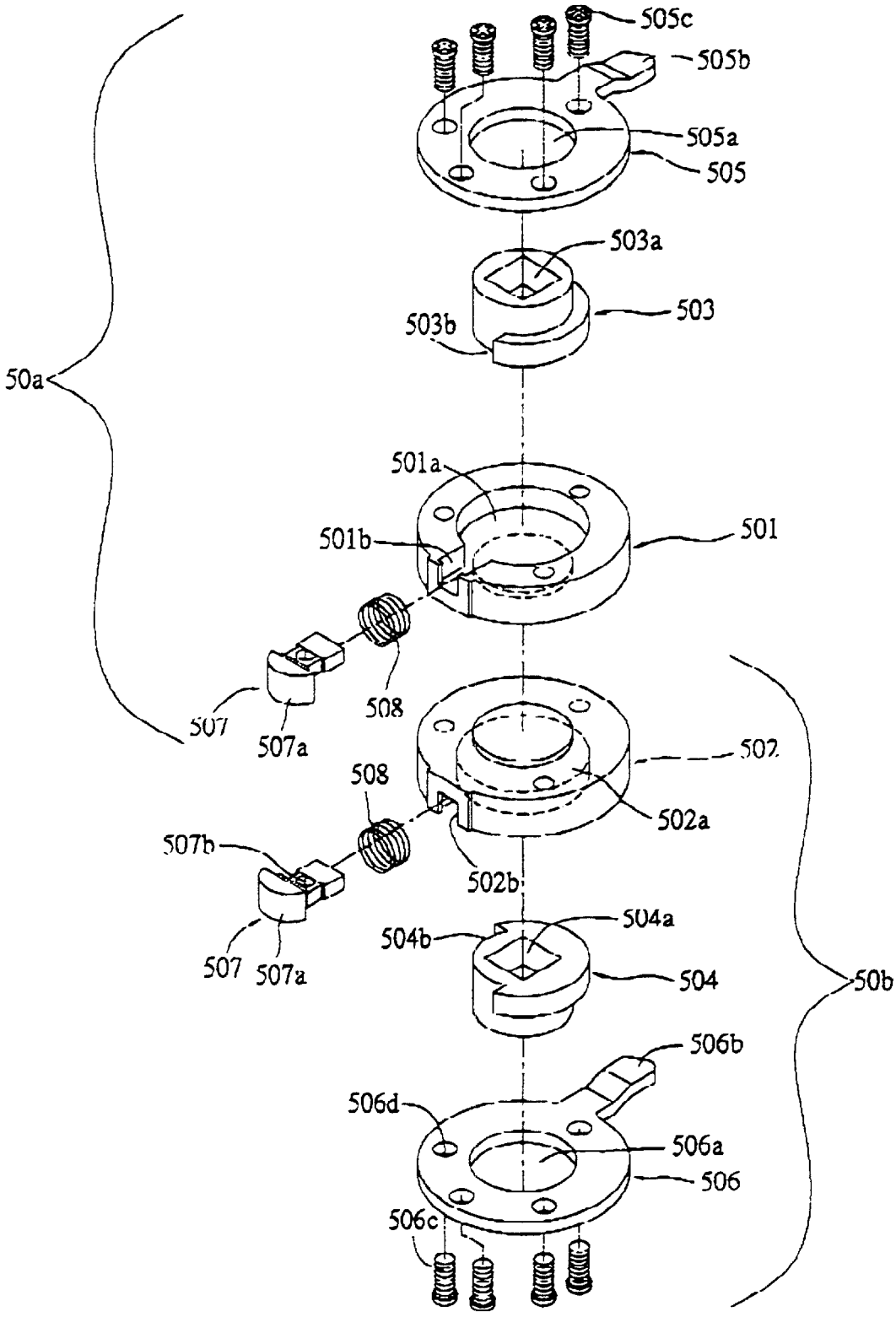
FIG. 6 is a structurally exploded view showing a first and a second doorknob mechanisms of the door lock of the invention.

As shown in FIGS. 5 and 6, the first doorknob mechanism 50*a* comprises: a first body 501 formed with a recessed portion 501*a*; a first pivot member 503 received in the recessed portion 501*a* of the first body 501, and externally connected to the first doorknob 70, so as to allow the first doorknob 70 to be operationally associated with the first pivot member 503; at least a first coupling member 507 adapted to be capable of being selectively coupled to the first body 501 and the first pivot member 503; a first fixture 505 attached onto the first body 501 and operationally associated with the latch bolt 401, the first fixture 505 being adapted for retaining the first pivot member 503 within the recessed portion 501*a* of the first body 501, and for preventing the first coupling member 507 from escaping out of the first body 501; and a control means 60 (as shown in FIG. 3) associated with the first coupling member 507, for manually controlling positioning of the first coupling member 507 with respect to the first body 501 and the first pivot member 503.

In more detail, the first body 501 of the first doorknob mechanism 50*a* is further formed with a groove 501*b* that extends outwardly from the recessed portion 501*a* of the first body 501. The first pivot member 503 is formed with a through hole 503*a* penetrating through the same, and a breach 503*b* at a periphery of the first pivot member 503, by which the first pivot member 503 is coupled to the first body 501 in a manner that, the through hole 503*a* communicates with the recessed portion 501*a* and the breach 503*b* corresponds in position to the groove 501*b* of the first body 501.

The first coupling member 507 is capable of being engaged in dimension with the groove 501*b* of the first body 501 and the breach 503*b* of the first pivot member 503. With the first coupling member 507 being coupled to at least the first body 501, the first coupling member 507 is externally formed with a stopper 507*a* outside the first body 501, which stopper 507*a* is dimensioned larger in diameter than the groove 501*b* of the first body 501, allowing an elastic means 508 e.g. a spring to be sleeved about the first coupling member 507 and interposed between the stopper 507*a* and the first body 501. The elastic means 508 provides a resilient force for pushing the first coupling member 507 toward away from the first body 501.

The first fixture 505 is formed with an opening 505*a* corresponding in position to the recessed portion 501*a* of the first body 501, and an arm 505*b* extending outwardly from a periphery of the first fixture 505. The first fixture 505 can be fixed to the first body 501 by a plurality of screws 505*c*, and the opening 505*a* is dimensioned in a manner that, the first pivot member 503 is accommodated within the opening 505*a* and prevented from escaping out of the first body 501. The arm 505*b* outwardly extends to be operationally associated with the latch bolt 401.

The first doorknob 70 is integrally fixed to the through hole 503*a* of the first pivot member 503 by a pivot 701, by which the first doorknob 70 operates as a whole with the first pivot member 503.

Figure 4:
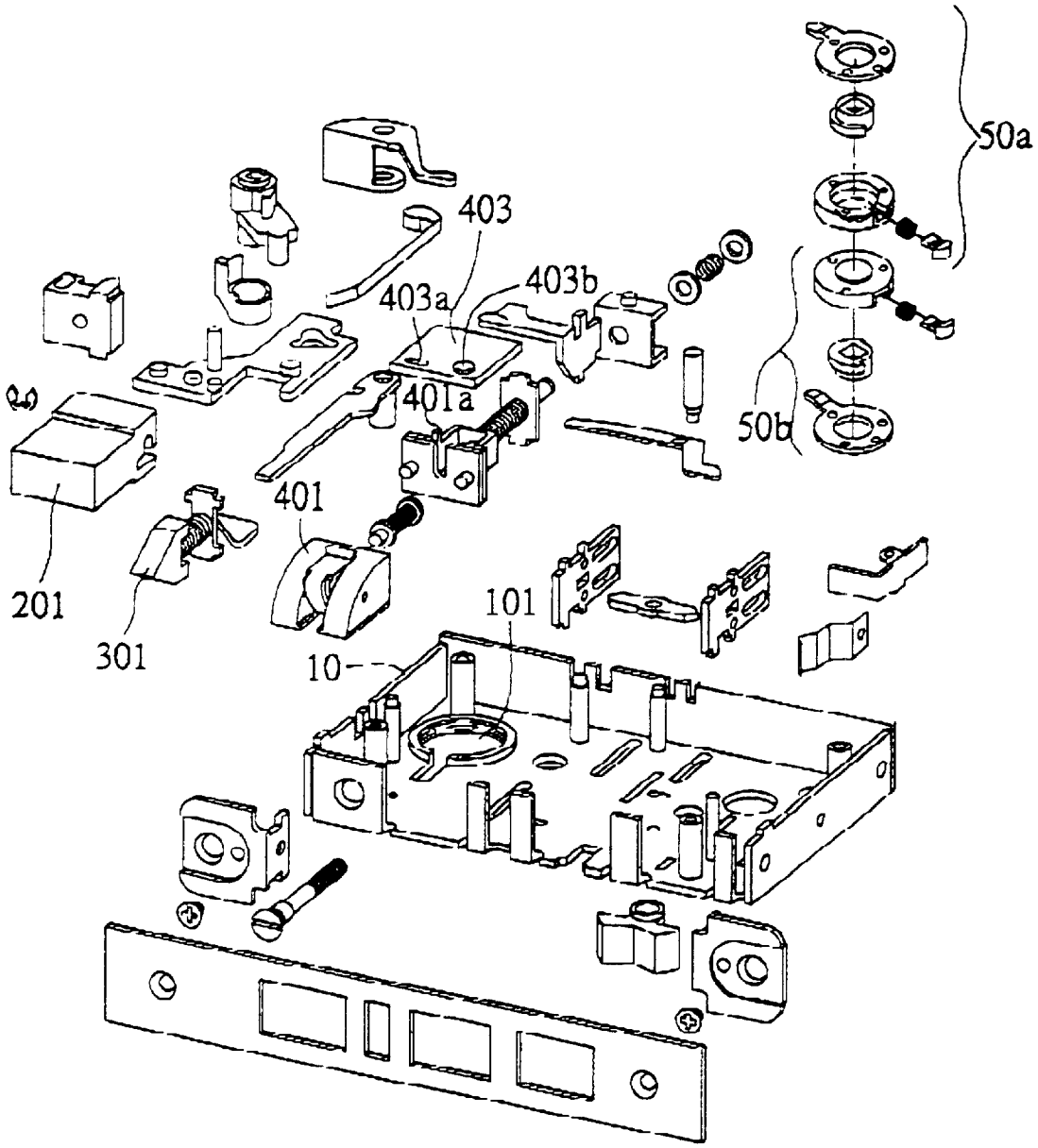
FIG. 4 is a structurally exploded view of the door lock of FIG. 2.

Further in view of FIGS. 3 and 4, the control means 60 is formed with a manually-operatable controller 601. As shown in the drawing, the manually-operatable controller 601 is a seesaw-shaped button that protrudes outwardly from a side of the housing 10. The control means 60 is further provided with two movable members 602, 603 connected to respective seesaw halves of the manually-operatable controller 601, and a connecting member 604 associated with the first coupling member 507 of the first doorknob mechanism 50*a*. Thereby, by manually operating the manually-operatable controller 601, the first coupling member 507 is operatably controlled in association with the control means 60.

Figure 7:
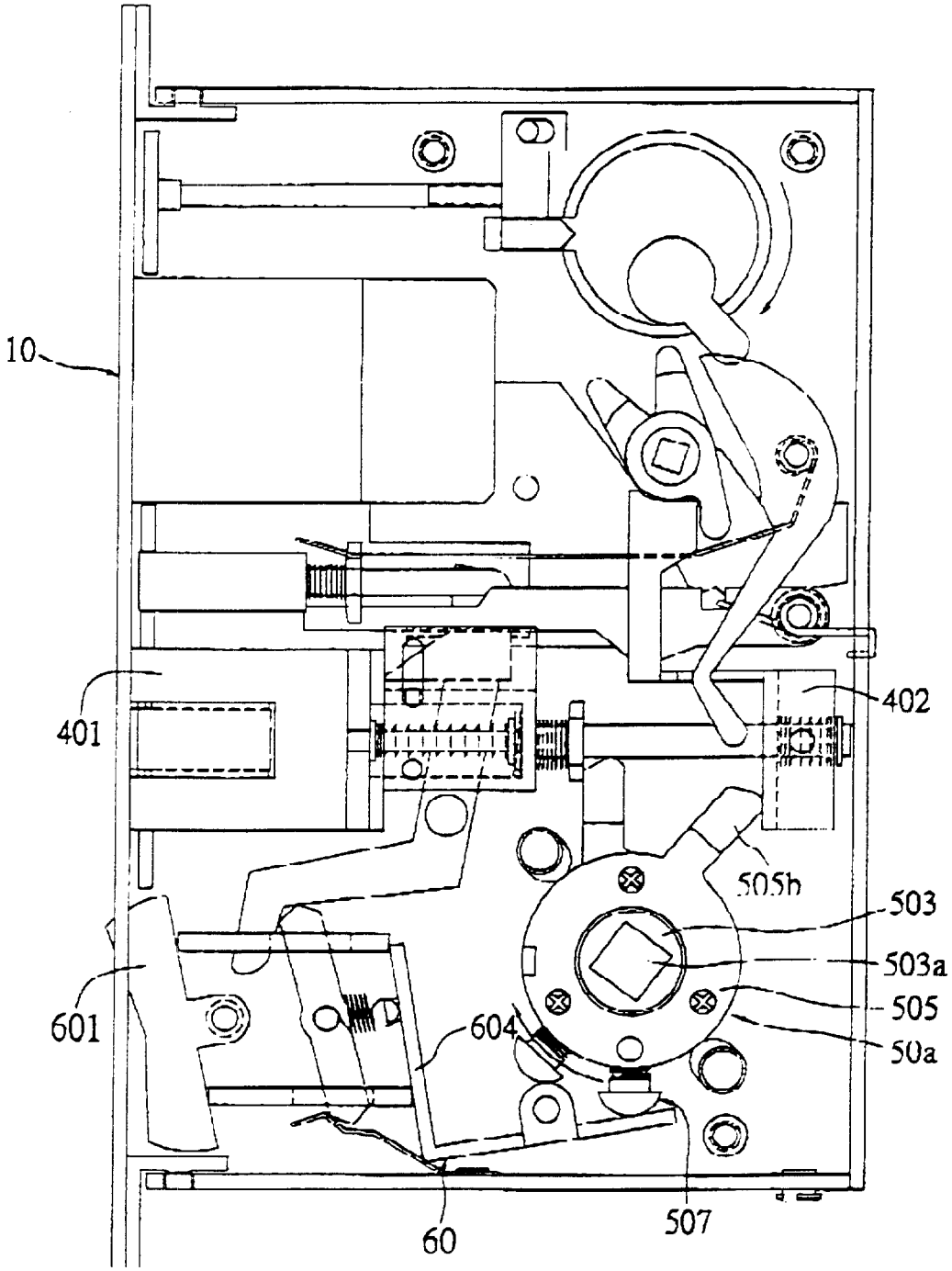
FIG. 7 is a schematic diagram showing operational association of the first doorknob with the first doorknob mechanism of the door lock of the invention.
Figure 8:
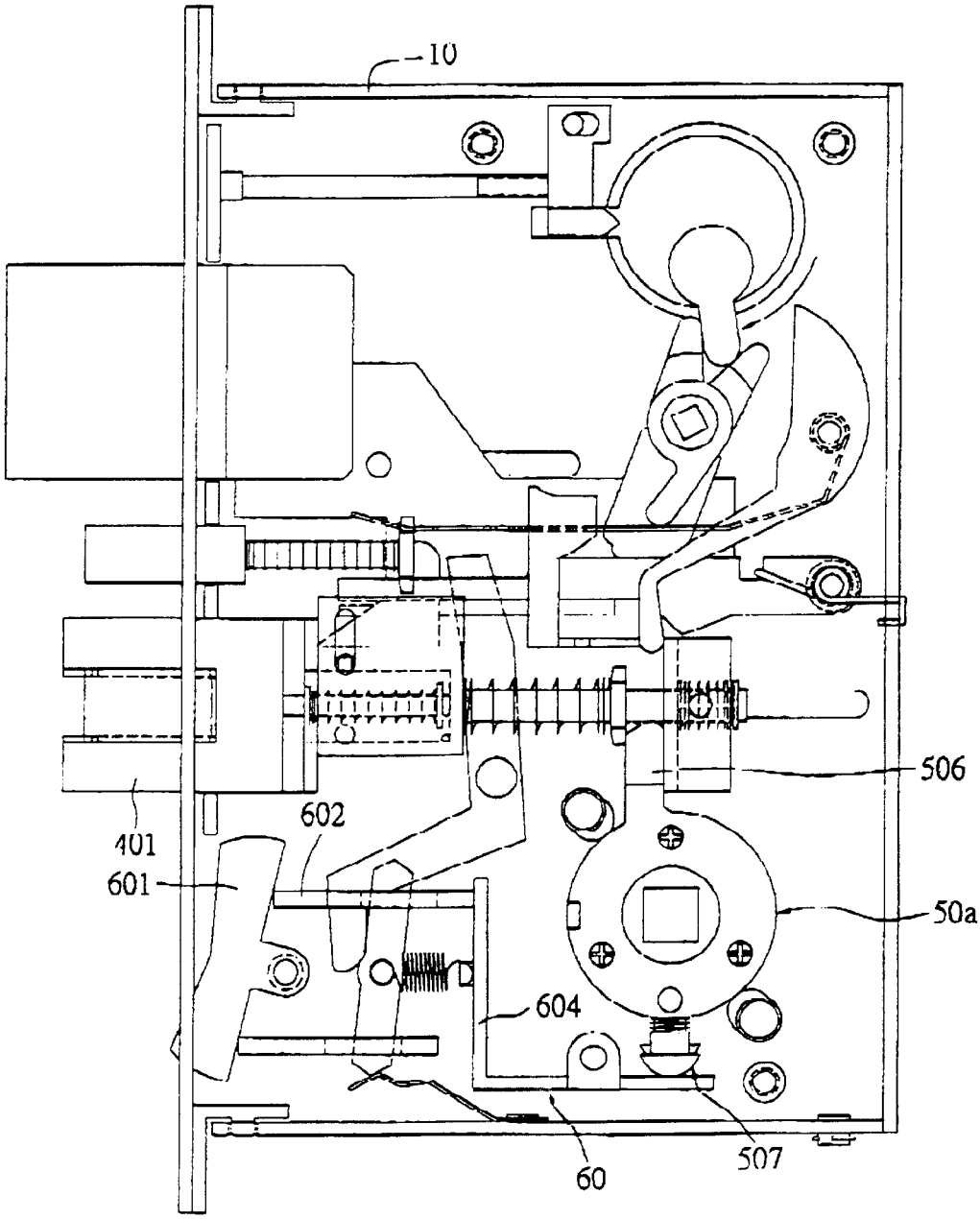
FIG. 8 is a schematic diagram showing operational dissociation of the first doorknob from the first doorknob mechanism of the door lock of the invention.

FIGS. 7–8 illustrate operational mechanisms in correlation between the above-described first doorknob mechanism 50*a* and the first doorknob 70 through the use of the door lock of the invention.

As shown in FIG. 7, it represents operational association of the first doorknob 70 with the first doorknob mechanism 50*a*. When the manually-operatable controller 601 of the control means 60 is pressed at its seesaw half along with the movable member 603 in a way illustrated in the drawing, the connecting member 604 is urged to push the first coupling member 507 toward inside of the first doorknob mechanism 50*a* in a manner that, the first coupling member 507 is simultaneously coupled to the groove 501*b* of the first body 501 and the breach 503*b* of the first pivot member 503 (further in view of FIG. 6).

By coupling of the first coupling member 507, the first body 501 and the first pivot member 503 are operationally associated as a whole, whereby the first doorknob mechanism 50*a* can be driven by the first doorknob 70 integrated with the first pivot member 503 (as shown in FIG. 5), and thus, the latch bolt 401 in connection to the first doorknob mechanism 50*a* can be consequently driven to manipulate the door lock. For example, as also shown in FIG. 7, the first doorknob mechanism 50*a* is actuated by the first doorknob 70 to turn clockwise (as indicated by an arrow beside the first doorknob mechanism 50*a*). This makes the arm 505*b* of the first fixture 505 push against a sliding member 402 toward rightward to an extent where the latch bolt 401 in association with the sliding member 402 can be entirely received in the housing 10, and thereby, the door lock is managed to open the door mounted with the door lock.

Alternatively, as shown in FIG. 8, it illustrates operational dissociation of the first doorknob 70 with the first doorknob mechanism 50*a*. When the manually-operatable controller 601 of the control means 60 is pressed at the other seesaw half along with the movable member 602, the connecting member 604 is sustained at a position where the first coupling member 507 is merely coupled to the groove 501*b* of the first body 501 but not extending into the breach 503*b* of the first pivot member 503 (further in view of FIG. 6), making the first pivot member 503 operationally decoupled from the first doorknob mechanism 50*a*. As a result, the first doorknob mechanism 50*a* cannot be driven by the first doorknob 70 integrated with the first pivot member 503 (as shown in FIG. 5), and the first doorknob 70 becomes idle. In the meantime, the door lock or the latch bolt 401 associated with the first doorknob mechanism 50*a* is not capable of being manipulated by the first doorknob 70.

This is the characteristic feature of this invention that, the first doorknob 70 usually assembled at the outside of the door (i.e. outside knob), can be selectively adapted to be operationally coupled or decoupled with respect to the first doorknob mechanism 50*a* of the door lock. By coupling of the outside knob, the door can be simply opened or closed through the use of the doorknob. In the case of the outside knob in operational dissociation from the door lock, the outside knob becomes idle and cannot operate to open the door when the door lock is fastened; this is greatly beneficial as to prevent the door lock from being damaged even if the outside knob is exerted with external impact or forcibly turned by a strong force.

Further referring to FIGS. 5 and 6, the second doorknob mechanism 50*b* is integrally connected to the first doorknob mechanism 50*a*, and comprises: a second body 502 formed with a recessed portion 502*a*, and engaged with the first body 501 of the first doorknob mechanism 50*a* in a manner that, the recessed portion 502*a* of the second body 502 is positionally opposed to the recessed portion 501 a of the first body 501; a second pivot member 504 received in the recessed portion 502*a* of the second body 502, and externally connected to the second doorknob 71, so as to allow the second doorknob 71 to be operationally associated with the second pivot member 504; at least a second coupling member 507 adapted to be simultaneously coupled to the second body 502 and the second pivot member 504; a second fixture 506 attached onto the second body 502 and associated with the latch bolt 401, the second fixture 506 being adapted for retaining the second pivot member 504 within the recessed portion 502*a* of the second body 502, and for holding the second coupling member 507 in position; and at least a fixing means (e.g. screw) 506*c* for integrally connecting the second fixture 506, the second coupling member 507 and the second body 502, so as to allow the second pivot member 504 and the second doorknob 71 to cooperate with the second doorknob mechanism 50*b* as a whole for driving the latch bolt 401 to operate.

The second doorknob mechanism 50*b* is structurally similar to the first doorknob mechanism 50*a*, but arranged with its components in an opposite manner relative to the first doorknob mechanism 50*a*.

Similarly in the second doorknob mechanism 50*b*, the second body 502 thereof is formed with a groove 502*b* that extends outwardly from the recessed portion 502*a* of the second body 502. The second pivot member 504 is formed with a through hole 504*a* penetrating through the same, and a breach 504*b* at a periphery of the second pivot member 504, by which the second pivot member 504 is coupled to the second body 502 in a manner that, the through hole 504*a* communicates with the recessed portion 502*a* and the breach 504*b* corresponds in position to the groove 502*b* of the second body 502.

The second coupling member 507 is coupled to both the groove 502*b* of the second body 502 and the breach 504*b* of the second pivot member 504 in a manner that, the second coupling member 507 is externally formed with a stopper 507*a* outside the second body 502, which stopper 507*a* is dimensioned larger in diameter than the groove 502*b* of the second body 502, allowing an elastic means 508 e.g. a spring to be sleeved about the second coupling member 507 and interposed between the stopper 507*a* and the second body 502. The elastic means 508 provides a resilient force for pushing the second coupling member 507 toward away from the second body 502.

The second coupling member 507 is formed with an aperture 507*b* that penetrates through the same and corresponds in position to the groove 502*b* of the second body 502. The second fixture 506 is formed with at least a hole 506*d* that penetrates through the same and corresponds in position to the aperture 507*b* of the second coupling member 507. This allows the fixing means 506*c* to penetrate through the hole 506*d* of the second fixture 506 and the aperture 507*b* of the second coupling member 507 to reach the groove 502*b* of the second body 502, so as to interconnect the second fixture 506, the second coupling member 507 and the second body 502.

The second fixture 506 is further formed with an opening 506*a* corresponding in position to the recessed portion 502*a* of the second body 502, and an arm 506*b* extending outwardly from a periphery of the second fixture 506. The second fixture 506 can be fixed to the second body 502 also by a plurality of the fixing means 506*c*, and the opening 506*a* is dimensioned to accommodate the second pivot member 504 therewithin and to prevent it from escaping out of the second body 502. The arm 506*b* outwardly extends to be operationally associated with the latch bolt 401.

The primary difference of the second doorknob mechanism 50*b* from the first doorknob mechanism 50*a* is that, the second doorknob 71 together with the second pivot member 504 operate with the second doorknob mechanism 50*b* as a whole, instead of being selectively decoupled from the second doorknob mechanism 50*b*.

Figure 9:
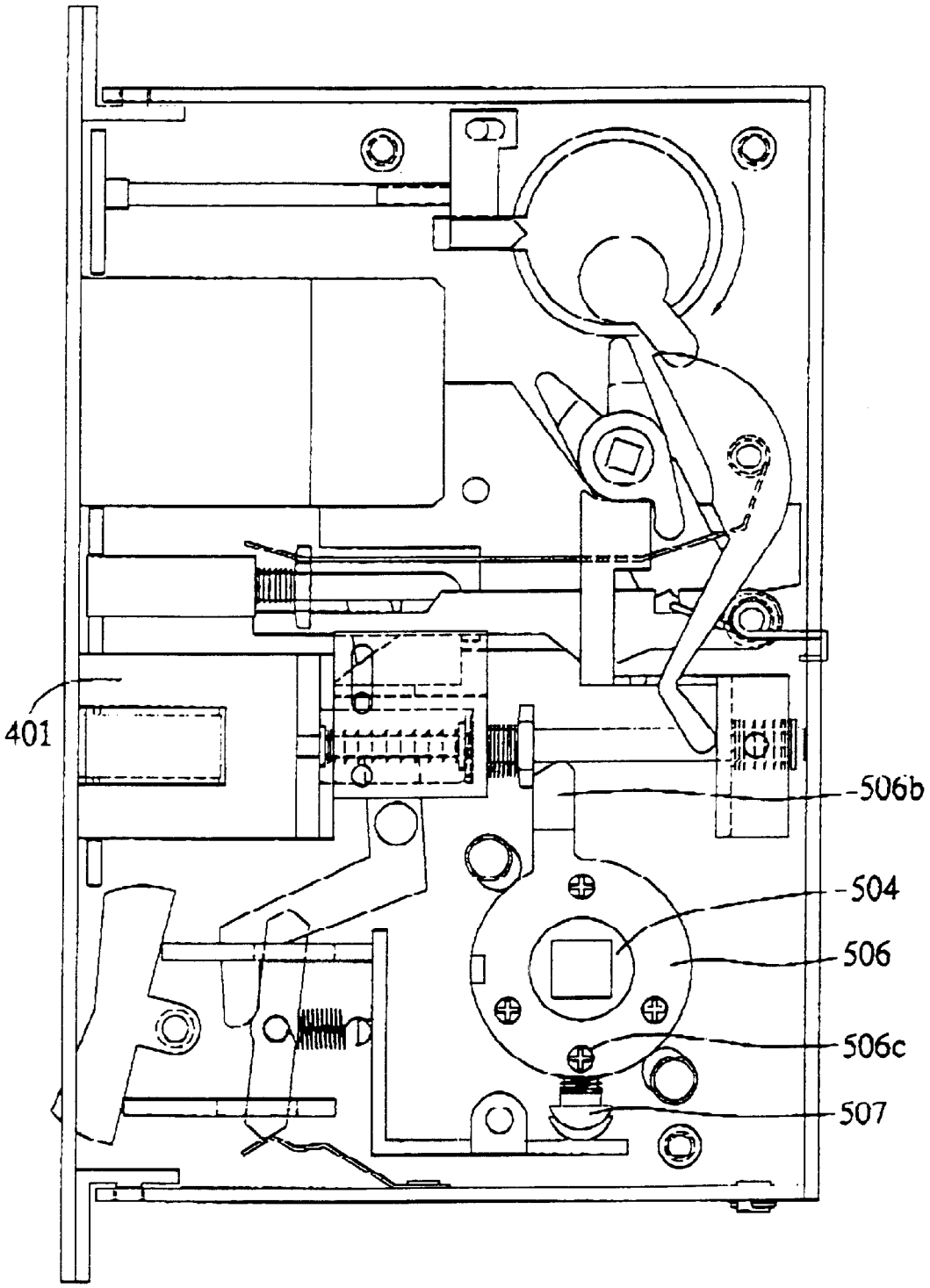
FIG. 9 is a schematic diagram showing operational association of the second doorknob with the second doorknob mechanism of the door lock of the invention.

Therefore, in operation of the second doorknob mechanism 50*b*, as shown in FIG. 9, with the provision of the fixing means 506*c* for fixing the second coupling member 507 at a position where the second pivot member 504 is coupled with the second coupling member 507, the second doorknob 71 that operatably drives the second pivot member 504 would integrally operate with the second doorknob mechanism 50*b*, which is connected to the latch bolt 401 by the arm 506*b* of the second fixture 506. Therefore, by simply manipulating the second doorknob 71, the latch bolt 401 can be urged to open or close the door equipped with the door lock of the invention. As such, the second doorknob 71 together with the second doorknob mechanism 50*b* are preferably installed at the inside of the door.

In another embodiment of this invention, as shown in FIG. 3, the door lock is further provided with a fireproof mechanism 402, which comprises a blocking member 403 associated with the latch bolt 401, and a positioning means 404 for allowing the blocking member 403 to be interposed between the latch bolt 401 and the positioning means 404. The positioning means 404 is formed with a movable portion 404*a* and a fixed portion 404*b*, wherein the blocking member 403 is shifted from a first position in contact with the movable portion 404*a* of the positioning means 404, to a second position in contact with the fixed portion 404*b* of the positioning means 404 in response to high temperature.

The blocking member 403 is formed with a groove 403*a*, which is coupled with a protrusion 401*a* for allowing the blocking member 403 to slide in position. As shown in the drawing, the blocking member 403 is held at the first position in contact with the movable portion 404*a* of the positioning means 404 by means of a thermally-meltable support member 403*b* that protrudes toward the latch bolt 401 to be engaged with the latch bolt 401. In this case, the latch bolt 401 is operatably driven by the doorknob (not shown) to open or close the door. When the door lock is burned with a fire, the support member 403*b* melts under high temperature of the fire, and the blocking member 403 is released from the first position to the second position in contact with the fixed portion 404*b* of the positioning means 404. The fixed portion 404*b* prevents the latch bolt 401 from being operationally driven by the doorknob, and keeps the latch bolt 401 in a status for fastening the door lock. This therefore inhibits the door from being opened during the fire, thereby confining spreading of the fire to minimize fire-induced damage.

Figure 10:
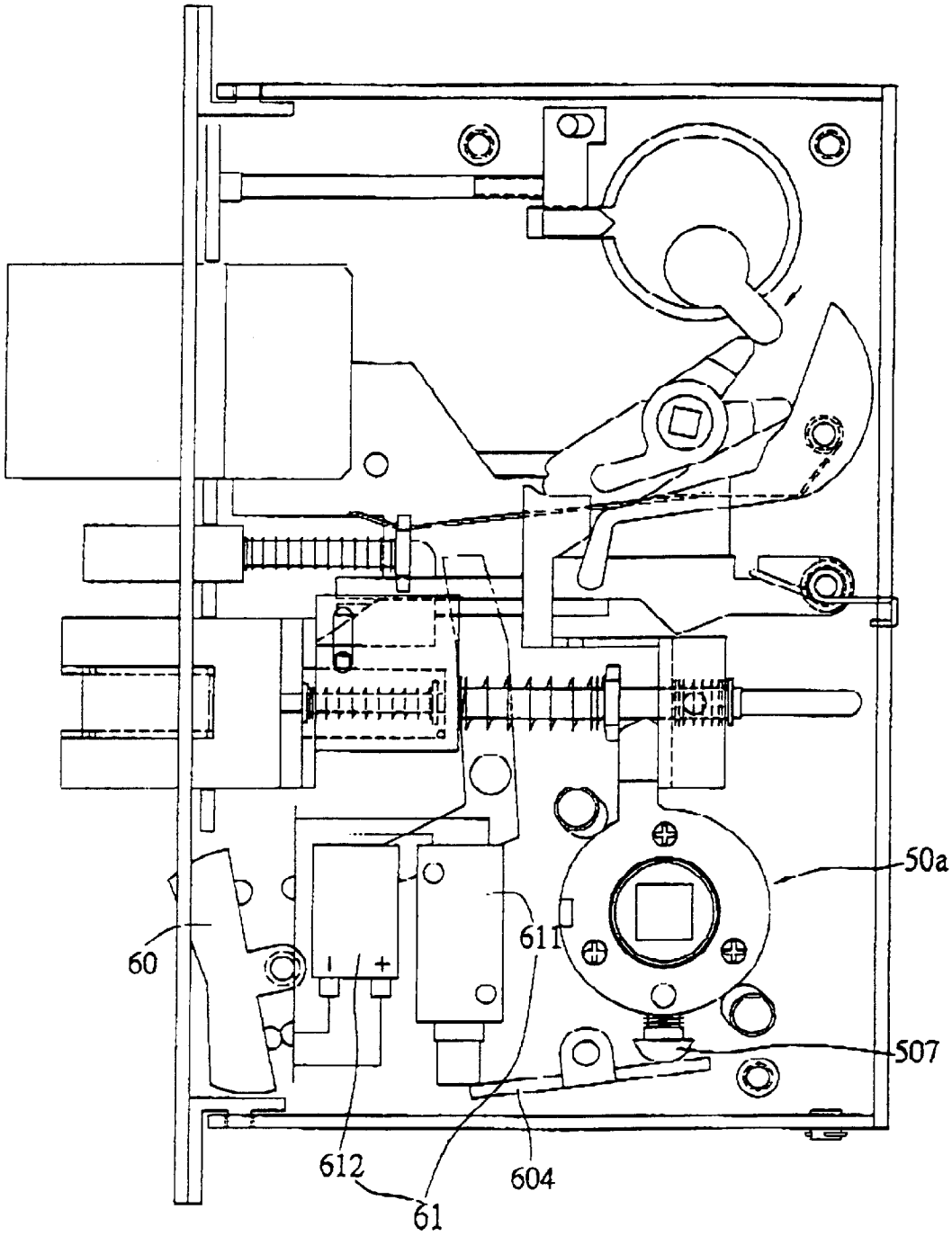
FIG. 10 is a schematic diagram showing internal structure of another preferred embodiment of the door lock of the invention.

In a further embodiment of this invention, as shown in FIG. 10, the control means 60 of the first doorknob mechanism 50*a* is associated with the first coupling member 507 by a power means 61, which provides power for driving operational association between the control means 60 and the first coupling member 507.

The power means 61 includes a driving member 611 connected to the connecting member 604 that is operationally associated with the first coupling member 507, and a power source (e.g. battery) 612 for providing power to operate the driving member 611. This thereby allows the control means 60 to be electrically motivated for positioning the first coupling member 507 and controlling the operational status of the first doorknob 70 with respect to the first doorknob mechanism 50*a*, as above described with reference to FIGS. 7 and 8.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A door lock, comprising:

a housing for receiving internal components of the door lock therein; and a first and a second doorknobs externally connected to the internal components of the door lock; wherein the internal components of the door lock comprise:

a dead bolt adapted to be operatably driven by a key through a keyhole formed on the housing;

a latch bolt adapted to be operatably driven by at least one of the first and second doorknobs;

a first doorknob mechanism associated with the latch bolt and the first doorknob, the first doorknob mechanism comprising:

a first body formed with a recessed portion;

a first pivot member received in the recessed portion of the first body, and connected to the first doorknob, so as to allow the first doorknob to be operationally associated with the first pivot member;

at least a first coupling member adapted to be capable of being selectively coupled to the first body and the first pivot member;

a first fixture attached onto the first body and associated with the latch bolt, the first fixture being adapted for retaining the first pivot member within the recessed portion of the first body, and for preventing the first coupling member from escaping out of the first body; and a control means associated with the first coupling member, for manually controlling positioning of the first coupling member with respect to the first body and the first pivot member; and a second doorknob mechanism connected to the first doorknob mechanism, and associated with the latch bolt and the second doorknob; the second doorknob mechanism comprising:

a second body formed with a recessed portion, and engaged with the first body of the first doorknob mechanism in a manner that, the recessed portion of the second body is positionally opposed to the recessed portion of the first body;

a second pivot member received in the recessed portion of the second body, and connected to the second doorknob, so as to allow the second doorknob to be operationally associated with the second pivot member;

at least a second coupling member adapted to be simultaneously coupled to the second body and the second pivot member;

a second fixture attached onto the second body and associated with the latch bolt, the second fixture being adapted for retaining the second pivot member within the recessed portion of the second body, and for holding the second coupling member in position; and at least a fixing means for integrally connecting the second fixture, the second coupling member and the second body, so as to allow the second pivot member and the second doorknob to cooperate with the second doorknob mechanism as a whole for driving the latch bolt to operate.

2. The door lock of claim 1, wherein the first body is further formed with a groove that extends outwardly from the recessed portion of the first body.

3. The door lock of claim 2, wherein the first pivot member is formed at a periphery thereof with a breach corresponding in position to the groove of the first body.

4. The door lock of claim 3, wherein the first coupling member is capable of being coupled in dimension to the groove of the first body and the breach of the first pivot member.

5. The door lock of claim 2, wherein the first coupling member is externally connected to a stopper outside the first body, the stopper being dimensioned larger in diameter than the groove of the first body, allowing an elastic means to be sleeved about the first coupling member and interposed between the stopper and the first body.

6. The door lock of claim 5, wherein the elastic means provides a resilient force for pushing the first coupling member away from the first body.

7. The door lock of claim 4, wherein the control means is formed with a manually-operatable controller.

8. The door lock of claim 7, wherein the manually-operatable controller is a button that protrudes outwardly from a side of the housing.

9. The door lock of claim 7, wherein the manually-operatable controller is urged to control the first coupling member to be simultaneously coupled to the groove of the first body and the breach of the first pivot member, so as to allow the first pivot member and the first doorknob to cooperate with the first doorknob mechanism as a whole for driving the latch bolt to operate.

10. The door lock of claim 7, wherein the manually-operatable controller is urged to control the first coupling member to be coupled to the groove of the first body and free of interference with the breach of the first pivot member, so as to allow the first pivot member and the first doorknob to be operationally separate from the first body, the first fixture and the latch bolt associated with the first fixture.

11. The door lock of claim 1, wherein the control means is associated with the first coupling member by a power means, which provides power for driving operational association between the control means and the first coupling member.

12. The door lock of claim 1, wherein the second body is further formed with a groove that extends outwardly from the recessed portion of the second body.

13. The door lock of claim 12, wherein the second coupling member is formed with an aperture that penetrates through the same and corresponds in position to the groove of the second body.

14. The door lock of claim 13, wherein the second fixture is formed with a through hole that penetrates through the same and corresponds in position to the aperture of the second coupling member.

15. The door lock of claim 14, wherein the fixing means penetrates through the through hole of the second fixture and the aperture of the second coupling member to reach the groove of the second body, so as to interconnect the second fixture, the second coupling member and the second body.

16. The door lock of claim 12, wherein the second coupling member is externally connected to a stopper outside the second body, the stopper being dimensioned larger in diameter than the groove of the second body, allowing an elastic means to be sleeved about the second coupling member and interposed between the stopper and the second body.

17. The door lock of claim 16, wherein the elastic means provides a resilient force for pushing the second coupling member away from the second body.

18. The door lock of claim 1, the internal components thereof further comprising:

a fireproof mechanism having a blocking member associated with the latch bolt, and a positioning means for allowing the blocking member to be interposed between the latch bolt and the positioning means, the positioning means being formed with a movable portion and a fixed portion, wherein the blocking member is shifted from a first position in contact with the movable portion of the positioning means, to a second position in contact with the fixed portion of the positioning means in response to high temperature.

19. The door lock of claim 18, wherein the latch bolt is operatably driven by a doorknob when the blocking member is held at the first position.

20. The door lock of claim 18, wherein the latch bolt is kept in a position for fastening the door lock and operationally blocked by the fixed portion of the positioning means, when the blocking member is held at the second position.

* * * * *